US008683972B2

(12) United States Patent
Taenzer

(10) Patent No.: US 8,683,972 B2
(45) Date of Patent: Apr. 1, 2014

(54) CRANKCASE AND METHOD OF MANUFACTURING SAME

(75) Inventor: Lars Taenzer, Unterschleissheim (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 33 days.

(21) Appl. No.: 13/460,352

(22) Filed: Apr. 30, 2012

(65) Prior Publication Data

US 2012/0234284 A1 Sep. 20, 2012

Related U.S. Application Data

(63) Continuation of application No. PCT/EP2010/006025, filed on Oct. 2, 2010.

(30) Foreign Application Priority Data

Oct. 31, 2009 (DE) ..... 10 2009 051 517

(51) Int. Cl.
*F02B 75/06* (2006.01)

(52) U.S. Cl.
USPC ..... 123/192.2

(58) Field of Classification Search
USPC ..... 123/192.2
See application file for complete search history.

(56) References Cited

U.S. PATENT DOCUMENTS

| | | | | |
|---|---|---|---|---|
| 5,199,166 | A | 4/1993 | Torigai et al. | |
| 5,671,930 | A | 9/1997 | Cho | |
| 5,806,481 | A * | 9/1998 | Ikegaya | 123/193.2 |
| 7,171,935 | B2 * | 2/2007 | Komai et al. | 123/193.2 |
| 2006/0032473 | A1 | 2/2006 | Boehm et al. | |
| 2010/0288214 | A1 * | 11/2010 | Pelmear | 123/41.86 |

FOREIGN PATENT DOCUMENTS

| | | | |
|---|---|---|---|
| CH | 672 353 | A5 | 11/1989 |
| DE | 29 32 506 | A1 | 2/1981 |
| DE | 10 2004 038 183 | A1 | 3/2006 |
| DE | 102 41 370 | B4 | 9/2007 |
| DE | 10 2009 008 741 | A1 | 8/2010 |
| WO | WO 00/37789 | A1 | 6/2000 |

OTHER PUBLICATIONS

German Search Report dated Jun. 23, 2010 with partial English translation (nine (9) pages).
International Search Report dated Feb. 14, 2011 with English translation (six (6) pages).

* cited by examiner

*Primary Examiner* — Lindsay Low
*Assistant Examiner* — Charles Brauch
(74) *Attorney, Agent, or Firm* — Crowell & Moring LLP

(57) ABSTRACT

A crankcase is provided for an internal combustion engine with at least one coated cylinder bore, which has a chamfer on a separating surface facing a cylinder head. A countersink is arranged on the chamfer. The geometry allows an additional grinding process on a separating surface facing a cylinder head to be omitted.

17 Claims, 1 Drawing Sheet

CRANKCASE AND METHOD OF MANUFACTURING SAME

CROSS-REFERENCE TO RELATED APPLICATIONS

This application is a continuation of PCT International Application No. PCT/EP2010/006025, filed Oct. 2, 2010, which claims priority under 35 U.S.C. §119 from German Patent Application No. DE 10 2009 051 517.8, filed Oct. 31, 2009, the entire disclosures of which are herein expressly incorporated by reference.

BACKGROUND AND SUMMARY OF THE INVENTION

The invention relates to a crankcase for an internal-combustion engine having at least one coated cylinder bore.

The invention is based on the International Patent Application, Publication Number WO 00/37789, the specification of which is expressly incorporated herein by reference. From that application, a cylinder crankcase is known, particularly for an internal-combustion engine, having at least one cylinder bore for receiving a piston. It is provided that the cylinder bore has an inlet chamfer on the cylinder head surface, or the separating surface, of the cylinder crankcase, and the cylinder face is provided with a thermal coating up to a transition to the inlet chamfer.

In the case of the machining known from the prior art—the producing of the separating surface at the crankcase with respect to a cylinder head, different materials—the crankcase material and the slide way coating—are machined simultaneously. After the machining of the cover surface or separating surface facing the cylinder head, it is therefore necessary to grind this surface again because, during the milling of the cover or separating surface, particles are set free which may scratch the cover surface or separating surface in an inadmissible manner.

It is an object of the present invention to avoid the above-mentioned disadvantage. This and other objects are achieved by a crankcase for an internal-combustion engine having at least one coated cylinder bore, which has a chamfer at a separating surface with respect to a cylinder head. A countersink is arranged at the chamfer.

When placing the required chamfer for the later introduction of a piston—the so-called piston introduction chamfer—, a countersink is placed at the same time (the countersink may simultaneously already be provided in the tool), which countersink is designed such that, while taking into account all tolerances during the machining of the cylinder surfaces and separation surfaces, only the crankcase casting material has to be machined. As a result of the use of the chamfer with the countersink, an additional grinding process is no longer necessary when machining the crankcase (machining of the separating surface). This saves investments in an additional grinding machine and, naturally, machining time, because of the elimination of a complete machining operation. The countersink can preferably be implemented isochronously with the placing of the chamfer.

The dimensional details wherein the chamfer has an angle a of between 5° and 60° with respect to the cylinder bore, and the countersink has a depth of at least 0.05 mm and a diameter that is by at least 0.1 mm greater than the chamfer, represent particularly preferred embodiments.

The manufacturing in a metal removing manner is particularly preferred. It may, for example, involve grinding, milling, etc.

Particularly preferably, the chamfer and the countersink are manufactured in a single operation.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
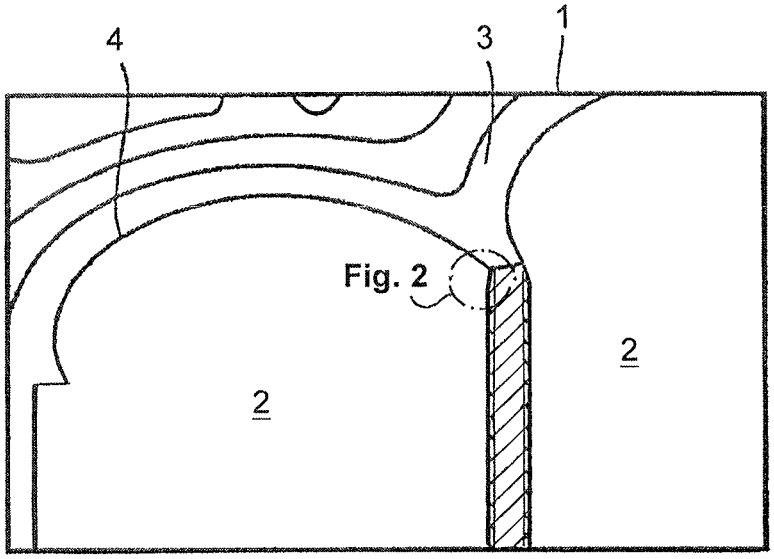
FIG. 1 is a sectional top perspective view of a position of a three-dimensionally illustrated crankcase according to an embodiment of the invention.

FIG. 1 is a sectional top perspective view of a three-dimensionally shown crankcase 1. The present embodiment, for example, is a crankcase 1 having three recognizable coated cylinder bores 2, the embodiment according to the invention being providable at any arbitrary crankcase for an internal-combustion engine with at least one coated cylinder bore. This crankcase 1 has a separating surface 3 with respect to a cylinder head, which is not shown. As known from the state of the art, a transition is chamfered from the cylinder bore 2 to the separating surface 3 for the purpose of a better introduction of a piston, which is not shown, (piston introduction chamfer).

According to an embodiment of the invention, a countersink 5 is arranged at the chamfer 4. Particularly preferably, the crankcase 1 is a light metal crankcase, preferable made of a hypoeutectic aluminum silicon alloy, such as AlSi9Cu3. Furthermore, the cylinder bore 2 is coated, whereby the latter is provided on its surface with a greater hardness for an improved tribology with a piston ring than the remaining material of the crankcase 1.

Figure 2:
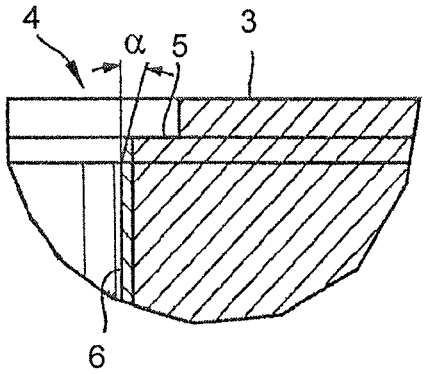
FIG. 2 is a two-dimensional sectional view of an enlargement of a detail of a cylinder bore of FIG. 1.

FIG. 2 is a two-dimensional sectional view of an enlargement of a detail of the cylinder bore of FIG. 1. FIG. 2 is a construction drawing of the chamfer 4 according to an embodiment of the invention with the countersink 5. The crankcase 1 is illustrated in a hatched manner, and in this embodiment, the chamfer 4 is arranged in the cylinder bore 2 only in a coating 6. However, depending on the tolerance situation, the chamfer 4 may also extend into the base material (here, AlSi9Cu3).

Particularly preferably, the chamfer 4 has an angle a between 5° and 60° with respect to the cylinder bore 2. Also particularly preferably, the countersink 5 may have a depth of at least 0.05 mm and a diameter that is at least 0.1 mm greater than the chamfer 4. Also particularly preferably, the chamfer 4 and the countersink 5 are produced in a metal-removing manner, as, for example, by a grinding or milling process, etc. Also particularly preferably, the chamfer 4 and the countersink 5 are produced in a single operation.

| Table of Reference Numbers: | |
|---|---|
| 1 | Crankcase |
| 2 | Cylinder bore |
| 3 | Separating surface |
| 4 | Chamfer |
| 5 | Countersink |
| 6 | Coating |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A crankcase for an internal-combustion engine, comprising:

at least one coated cylinder bore of the crankcase, wherein an upper end of the at least one coated cylinder bore is chamfered, and a countersink extends radially from the chamfered upper end of the at least one coated cylinder bore.

2. The crankcase according to claim 1, wherein the chamfer has an angle $\alpha$ of between 5° and 60° relative to the cylinder bore.

3. The crankcase according to claim 2, wherein the countersink has a depth of at least 0.05 mm and a diameter greater than the chamfer by at least 0.1 mm.

4. The crankcase according to claim 1, wherein the chamfer and the countersink are obtained by removing metal from the crankcase.

5. The crankcase according to claim 2, wherein the chamfer and the countersink are obtained by removing metal from the crankcase.

6. The crankcase according to claim 3, wherein the chamfer and the countersink are obtained by removing metal from the crankcase.

7. The crankcase according to claim 1, wherein the chamfer and the countersink are produced in a single manufacturing operation.

8. The crankcase according to claim 4, wherein the chamfer and the countersink are produced in a single manufacturing operation.

9. The crankcase according to claim 6, wherein the chamfer and the countersink are produced in a single manufacturing operation.

10. A method of manufacturing a crankcase for an internal-combustion engine, the method comprising the acts of:

forming at least one coated cylinder bore;

chamfering an upper end of the at least one coated cylinder bore; and forming a countersink that extends radially from the chamfered upper end of the at least one coated cylinder bore.

11. The method according to claim 10, wherein the act of producing the chamfer and the countersink is carried out by removing metal from the crankcase at the separating surface.

12. The method according to claim 11, wherein the act of removing metal to produce the chamfer and the countersink occurs in a single manufacturing operation.

13. The method according to claim 10, wherein the chamfer is produced to have an angle $\alpha$ of between 5° and 60° with respect to the cylinder bore.

14. The method according to claim 10, wherein the countersink is produced to have a depth of at least 0.05 mm and a diameter that is greater than the chamfer by at least one 0.1 mm.

15. The method according to claim 13, wherein the countersink is produced to have a depth of at least 0.05 mm and a diameter that is greater than the chamfer by at least one 0.1 mm.

16. The crankcase according to claim 1, wherein the at least one coated cylinder bore, the chamfered upper end of the at least one coated cylinder bore, and the countersink define a continuous volume of space between a top of a piston, that is disposed within the at least one coated cylinder bore, and a cylinder head.

17. The method according to claim 10, wherein the at least one coated cylinder bore, the chamfered upper end of the at least one coated cylinder bore, and the countersink define a continuous volume of space between a top of a piston, that is disposed within the at least one coated cylinder bore, and a cylinder head.

* * * * *